US008132394B2

(12) United States Patent
Koike

(10) Patent No.: US 8,132,394 B2
(45) Date of Patent: Mar. 13, 2012

(54) BAG MANUFACTURING AND PACKAGING APPARATUS AND BAG MANUFACTURING AND PACKAGING METHOD

(75) Inventor: Shinji Koike, Shiga (JP)

(73) Assignee: Ishida Co., Ltd., Kyoto (JP)

( * ) Notice: Subject to any disclaimer, the term of this patent is extended or adjusted under 35 U.S.C. 154(b) by 336 days.

(21) Appl. No.: 12/444,317

(22) PCT Filed: Oct. 29, 2007

(86) PCT No.: PCT/JP2007/071043

§ 371 (c)(1),
(2), (4) Date: Apr. 3, 2009

(87) PCT Pub. No.: WO2008/053846

PCT Pub. Date: May 8, 2008

(65) Prior Publication Data

US 2010/0101188 A1 Apr. 29, 2010

(30) Foreign Application Priority Data

Oct. 31, 2006 (JP) ..... 2006-296226

(51) Int. Cl.
*B65B 9/00* (2006.01)

(52) U.S. Cl. ..... 53/451; 53/551

(58) Field of Classification Search ..... 53/113, 53/167, 374.5, 374.6, 451, 526, 548, 550, 53/551, 552, 436, 450

See application file for complete search history.

(56) References Cited

U.S. PATENT DOCUMENTS

| | | | | |
|---|---|---|---|---|
| 3,668,815 | A * | 6/1972 | Henry et al. | 53/437 |
| 4,291,520 | A * | 9/1981 | Prince et al. | 53/551 |
| 4,965,986 | A | 10/1990 | Klinkel | |
| 5,014,497 | A * | 5/1991 | McMahon | 53/451 |
| 5,125,213 | A * | 6/1992 | Focke et al. | 53/437 |
| 5,930,983 | A * | 8/1999 | Terminella et al. | 53/436 |
| 6,088,994 | A * | 7/2000 | Nakagawa et al. | 53/51 |
| 6,212,861 | B1 * | 4/2001 | Tsuruta | 53/551 |
| 7,779,612 | B2 * | 8/2010 | Fergusson et al. | 53/451 |
| 2002/0002810 | A1 | 1/2002 | Nakagawa et al. | |
| 2003/0213217 | A1 | 11/2003 | Kondo et al. | |
| 2005/0034422 | A1 * | 2/2005 | Ausnit | 53/133.4 |
| 2005/0039422 | A1 * | 2/2005 | Braun et al. | 53/551 |
| 2011/0154783 | A1 * | 6/2011 | Bierschenk et al. | 53/436 |
| 2011/0265432 | A1 * | 11/2011 | Iwasaki et al. | 53/548 |

FOREIGN PATENT DOCUMENTS

| | | | |
|---|---|---|---|
| JP | H02-152610 | A | 6/1990 |
| JP | H07-187110 | A | 7/1995 |
| JP | H08-175524 | A | 7/1996 |
| JP | 2000-095205 | A | 4/2000 |
| JP | 2003-335308 | A | 11/2003 |

* cited by examiner

*Primary Examiner* — Rinaldi Rada
*Assistant Examiner* — Eyamindae Jallow
(74) *Attorney, Agent, or Firm* — Global IP Counselors, LLP

(57) ABSTRACT

A bag manufacturing and packaging apparatus manufactures a bag by sealing a packaging material formed in a tubular shape and at the same time fills the bag with articles to be packaged. The bag manufacturing and packaging apparatus includes a conveyance mechanism, a squeezing mechanism and a conveyance adjusting unit. The conveyance mechanism is configured and arranged to convey the packaging material in a conveying direction. The squeezing mechanism includes a squeezing unit configured and arranged to sandwich the packaging material and to perform a squeezing motion so as to move the articles to be packaged to the downstream side in the conveying direction. The conveyance adjusting unit configured and arranged to move the packaging material towards the upstream side in the conveying direction during the squeezing motion of the squeezing unit.

10 Claims, 10 Drawing Sheets

BAG MANUFACTURING AND PACKAGING APPARATUS AND BAG MANUFACTURING AND PACKAGING METHOD

CROSS-REFERENCE TO RELATED APPLICATIONS

This national phase application claims priority to Japanese Patent Application No. 2006-296226 filed on Oct. 31, 2006. The entire disclosure of Japanese Patent Application No. 2006-296226 are hereby incorporated herein by reference

TECHNICAL FIELD

The present invention relates to a bag manufacturing and packaging apparatus. More specifically, the present invention relates to a bag manufacturing and packaging apparatus and a bag manufacturing and packaging method which manufactures a bag by sealing a packaging material formed in a tubular shape and at the same time filling the bag with articles to be packaged.

BACKGROUND ART

There is provided a bag manufacturing and packaging apparatus as a device that manufactures a bag and at the same time fills the bag with articles to be packaged such as foods.

For example, a vertical pillow packaging machine forms a packaging material, which is a sheet-like film, into a tubular shape by a former and a tube, and seals (thermal sealing) overlapping longitudinal edges of the tubular packaging material by a longitudinal sealing means. Then, the inside of the tubular packaging material that becomes a bag is filled with the articles to be packaged which drop through the tube, a portion across an upper portion of a bag and a lower portion of a subsequent bag is sealed by a transverse sealing mechanism disposed below the tube, and thereafter the center of the transverse seal portion is cut by a cutter.

With such a bag manufacturing and packaging apparatus, there is a problem that sealing failure occurs since sealing is performed in a state in which the articles to be packaged and the like are contained in the seal portion.

Therefore, with the bag manufacturing and packaging apparatus in JP-A Publication No. 8-175524 (published on Jul. 9, 1996), the moving speed of sealing jaws included in the transverse sealing mechanism with respect to the conveyance speed of the film is controlled, and thereby the sealing jaws do not only seal the film but also serve a role as a squeezing mechanism that squeezes the articles to be packaged from a transverse sealing position into a packaging material disposed below by coming into contact with the tubular packaging material. Accordingly, it is possible to prevent the above described sealing failure and also push bulky articles to be packaged into the packaging material disposed below. Thus, it is possible to improve a filling efficiency of the articles to be packaged into a product.

In addition, with regard to the demand for improving the filling efficiency of the articles to be packaged into the product, for example, JP-A Publication No. 2000-95205 (published on Apr. 4, 2000) discloses a bag manufacturing and packaging device provided with a shaking mechanism that imparts oscillation to a pre-sealed product in which articles to be packaged are contained so as to increase bulk density.

DISCLOSURE OF THE INVENTION

Recently, there have been demands for simplified packaging and environmental considerations, and a desire for further improvement of the filling efficiency of the articles to be packaged into the product. For these demands and desire, it is necessary that the shaking mechanism be provided for improving the filling efficiency of the articles to be packaged, and further, it is necessary to secure a long distance for the squeezing mechanism to squeeze the film (squeeze distance) to push bulky articles to be packaged into the product.

However, with the above described conventional bag manufacturing and packaging apparatus (bag manufacturing and packaging device), a significant improvement of the squeezing mechanism will be necessary in order to extend the squeeze distance by extending a distance in which the squeezing mechanism moves in the conveying direction.

An object of the present invention is to provide a bag manufacturing and packaging apparatus and a bag manufacturing and packaging method which can easily improve the filling efficiency of articles to be packaged into a product without modifying the squeezing mechanism.

A bag manufacturing and packaging apparatus according to a first aspect of the present invention is a bag manufacturing and packaging apparatus that manufactures a bag by sealing a packaging material formed in a tubular shape and at the same time fills the bag with articles to be packaged. The bag manufacturing and packaging apparatus includes a conveyance mechanism, a squeezing mechanism, and a conveyance adjusting unit. The conveyance mechanism is configured and arranged to convey the packaging material in a conveying direction. The squeezing mechanism includes a squeezing unit configured and arranged to sandwich the packaging material and to perform a squeezing motion so as to move the articles to be packaged to the downstream side in the conveying direction. The conveyance adjusting unit is configured and arranged to convey the packaging material towards the upstream side in the conveying direction during the squeezing motion of the squeezing unit.

Here, the conveyance adjusting unit moves the packaging material towards the upstream side in the conveying direction during the squeezing motion of the squeezing unit.

Here, the so-called squeezing motion to sandwich the packaging material so as to move the articles to be packaged to the downstream side in the conveying direction of packaging material does not only prevent a sealing failure that occurs due to the presence of the articles to be packaged in a seal portion at the time of sealing, but also serves as a function to improve a filling efficiency of the articles to be packaged into a product by pushing bulky articles to be packaged into the downstream portion of the packaging material. Additionally, this squeezing motion is generally performed as the squeezing mechanism sandwiches the packaging material and moves (slides) in the conveying direction.

With the conventional bag manufacturing and packaging apparatus, in order to further improve the filling efficiency of the articles to be packaged into the product, the distance for the squeezing unit to sandwich the packaging material and move in the conveying direction is extended in order to secure the long squeeze distance. Accordingly, it is possible to increase an amount to be pushed into the lower portion of the packaging material, and increase the filling efficiency of the articles to be packaged into the product. However, a significant improvement of the squeezing mechanism will be necessary to extend the distance for the squeezing unit to move in the conveying direction, which cannot be easily realized.

Therefore, the bag manufacturing and packaging apparatus of the present invention is provided with the conveyance adjusting unit that moves the packaging material towards the upstream side in the conveying direction during the squeezing motion of the squeezing unit.

Accordingly, the squeeze distance of the squeezing unit with respect to the packaging material can be extended by the distance of the movement of the packaging material towards the upstream side in the conveying direction caused by the conveyance adjusting unit. In other words, with the bag manufacturing and packaging apparatus of the present invention, the squeeze distance of the squeezing unit with respect to the packaging material is relatively extended by providing the conveyance adjusting unit, and thus, the squeeze distance is extended without significantly modifying the conventional squeezing mechanism.

As a result, the squeeze distance of the squeezing unit with respect to the packaging material can be extended without significantly modifying the squeezing mechanism, and the filling efficiency of the articles to be packaged into the product can be easily improved.

A bag manufacturing and packaging apparatus according to a second aspect of the present invention is the bag manufacturing and packaging apparatus according to the first aspect of the present invention, wherein the conveyance adjusting unit includes a clamping mechanism movable in the conveying direction and configured and arranged to clamp the packaging material, and a control unit configured to move the clamping mechanism while clamping the packaging material towards the upstream side in the conveying direction during the squeezing motion of the squeezing unit.

Here, in order to move the packaging material to the upstream side in the conveying direction during the squeezing motion of the squeezing unit, the clamping mechanism that clamps the packaging material is disposed so as to be movable in the conveying direction, and the control unit is configured to move the clamping mechanism while clamping the packaging material towards the upstream side in the conveying direction during the squeezing motion of the squeezing unit.

Accordingly, the squeeze distance of the squeezing unit with respect to the packaging material can be extended without significantly modifying the squeezing mechanism.

In addition, when the bag manufacturing and packaging apparatus is provided with a shaking mechanism, which, for example, clamps and oscillates the packaging material and thereby gathers the articles to be packaged in a vertically downward direction, it is possible to utilize the shaking mechanism as the conveyance adjusting unit. In other words, by modifying the above described shaking mechanism so as to be movable in the conveying direction and by controlling the movement during the squeezing motion of the squeezing unit, the squeeze distance can be easily extended compared with a case where modification of the squeezing mechanism is involved.

A bag manufacturing and packaging apparatus according to a third aspect of the present invention is the bag manufacturing and packaging apparatus according to the second aspect of the present invention, wherein the control unit is configured to move the clamping mechanism from the most downstream position to the most upstream position in the conveying direction during the squeezing motion of the squeezing unit.

Here, the control unit moves the clamping mechanism disposed on the most downstream side to the most upstream position in the conveying direction during the squeezing motion of the squeezing unit.

Note that the terms "most upstream position" and "most downstream position" used herein refer to the most upstream position and the most downstream position in the conveying direction of the packaging material within a movable range of the clamping mechanism. For example, the most upstream position is a position adjacent to the conveyance mechanism disposed on the upstream side of the clamping mechanism, and the most downstream position is a position adjacent to the squeezing mechanism disposed on the downstream side of the clamping mechanism.

Accordingly, the packaging material that is clamped can be moved to the full extent toward the upstream side in the conveying direction, so that it is possible to secure the maximum squeeze distance.

A bag manufacturing and packaging apparatus according to a fourth aspect of the present invention is the bag manufacturing and packaging apparatus according to the second or third aspect of the present invention, wherein the control unit is configured to oscillate the clamping mechanism before the squeezing unit starts the squeezing motion.

Here, the control unit oscillates the clamping mechanism to impart oscillation to the packaging material and gathers the articles to be packaged in the vertically downward direction before the squeezing unit starts the squeezing motion.

Accordingly, the bulkiness of the articles to be packaged can be reduced, so that the squeeze distance can be extended in the vertically downward direction. Thus, the transverse seal position can be shifted in the vertically downward direction by the corresponding distance. As a result, the size of the product can be reduced, and it is possible to further improve the filling efficiency of the articles to be packaged.

A bag manufacturing and packaging apparatus according to a fifth aspect of the present invention is the bag manufacturing and packaging apparatus according to any one of the second through fourth aspects of the present invention, wherein the control unit is configured to control the conveyance mechanism to stop conveying the packaging material at least during the squeezing motion of the squeezing unit and during clamping of the clamping mechanism.

Here, a so-called batch conveyance is performed in which the control unit causes the conveyance mechanism to stop conveying the packaging material at least during the squeezing motion of the squeezing unit and during clamping of the clamping mechanism.

Accordingly, even when the clamping mechanism moves in a direction opposite to the conveying direction in a state of clamping the packaging material, loosening of the packaging material can be minimized.

A bag manufacturing and packaging apparatus according to a sixth aspect of the present invention includes the conveyance adjusting unit configured to control the conveyance mechanism to convey the packaging material towards the upstream side in the conveying direction during the squeezing motion of the squeezing unit.

Here, in order to move the packaging material to the upstream side in the conveying direction during the squeezing motion of the squeezing unit, the conveyance mechanism is controlled to convey the packaging material in a direction opposite to the normal conveying direction during the squeezing motion of the squeezing unit.

Accordingly, it is possible to extend the squeeze distance with respect to the packaging material without significantly modifying the squeezing mechanism.

A bag manufacturing and packaging apparatus according to a seventh aspect of the present invention is the bag manufacturing and packaging apparatus according to any one of the first through sixth aspects of the present invention, wherein the squeezing mechanism is further configured to sandwich and seal the packaging material in a direction intersecting the conveying direction after finishing the squeezing motion.

Here, the squeezing mechanism does not only perform the squeezing motion with respect to the packaging material but also seals the packaging material.

Accordingly, the present invention can be applied to, for example, a type of bag manufacturing and packaging apparatus that performs the squeezing motion (so-called D-motion) with respect to the packaging material after sandwiching the packaging material in a direction intersecting the conveying direction and transversely sealing the same.

As a result, the filling efficiency of the articles to be packaged into the product can be easily improved without significantly modifying the sealing mechanism and the squeezing mechanism which rotates forming a complicated trajectory.

A bag manufacturing and packaging method according to an eighth aspect of the present invention is a bag manufacturing and packaging method of filling a tubular packaging material being conveyed in a conveying direction with articles to be packaged and sealing the packaging material. The bag manufacturing and packaging method includes performing a squeezing motion in which the packaging material is sandwiched to move the articles to be packaged to the downstream side in the conveying direction of the packaging material, and moving the packaging material towards the upstream side in the conveying direction during the squeezing motion in the first step.

Here, with the bag manufacturing and packaging method of sealing a packaging material filled with articles to be packaged while conveying the same to the downstream side in the conveying direction, the packaging material is moved towards the upstream side opposite to the conveying direction while the packaging material is subjected to the squeezing motion.

Here, by the step of performing the so-called squeezing motion in which the packaging material is sandwiched so as to move the articles to be packaged to the downstream side in the conveying direction, it is possible not only to prevent a sealing failure that occurs due to the presence of the articles to be packaged in a seal portion at the time of sealing but also improve the filling efficiency of the articles to be packaged into a product by pushing bulky articles to be packaged into the packaging materials below. Therefore, such squeezing motion step is generally performed in the bag manufacturing and packaging method of filling a tubular packaging material conveyed downward with articles to be packaged and sealing the same.

With the conventional bag manufacturing and packaging method, the squeeze distance is extended by securing the long distance for the squeezing unit to sandwich the packaging material and move in the conveying direction, thereby increasing the amount to be pushed into the packaging material disposed below and improving the filling efficiency of the articles to be packaged into the product. However, with such a method that secures the long distance for the squeezing unit to move in the conveying direction, a significant modification of the squeezing mechanism will be necessary.

Therefore, with the bag manufacturing and packaging method of the present invention, the distance for the squeezing unit to squeeze a packaging material is relatively extended by moving the packaging material to the upstream side opposite to the conveying direction during the time when the packaging material is subjected to the squeezing motion, instead of by extending the distance of the movement of the squeezing unit in the conveying direction.

Accordingly, it is possible to extend the squeeze distance with respect to the packaging material by the distance of the movement of the packaging material to the upstream side opposite to the conveying direction.

As a result, the squeeze distance with respect to the packaging material can be extended without significantly modifying the conventional squeezing mechanism, and thus the filling efficiency of the articles to be packaged into the product can be easily improved.

A bag manufacturing and packaging method according to a ninth aspect of the present invention is the bag manufacturing and packaging method according to the eighth aspect of the present invention, further including oscillating the packaging material before the performing of the squeezing motion.

Here, the packaging material is oscillated before the packaging material is subjected to the squeezing motion, and thereby the articles to be packaged are gathered in the vertically downward direction.

Accordingly, the bulkiness of the articles to be packaged can be reduced, so that the squeeze distance can be extended to the vertically downward direction. Thus, the transverse seal position can be shifted in the vertically downward direction by the corresponding distance. As a result, the size of the product can be reduced, and it is possible to further improve the filling efficiency of the articles to be packaged.

With the bag manufacturing and packaging apparatus according to the present invention, it is possible to extend the squeeze distance with respect to the packaging material without modifying the squeezing mechanism and the filling efficiency of the articles to be packaged into the product can be easily improved.

BEST MODE FOR CARRYING OUT THE INVENTION

A bag manufacturing and packaging apparatus according to an embodiment of the present invention is described below with reference to FIGS. 1 to 7.

Overall Structure of Bag Manufacturing and Packaging Apparatus 1

Figure 1:
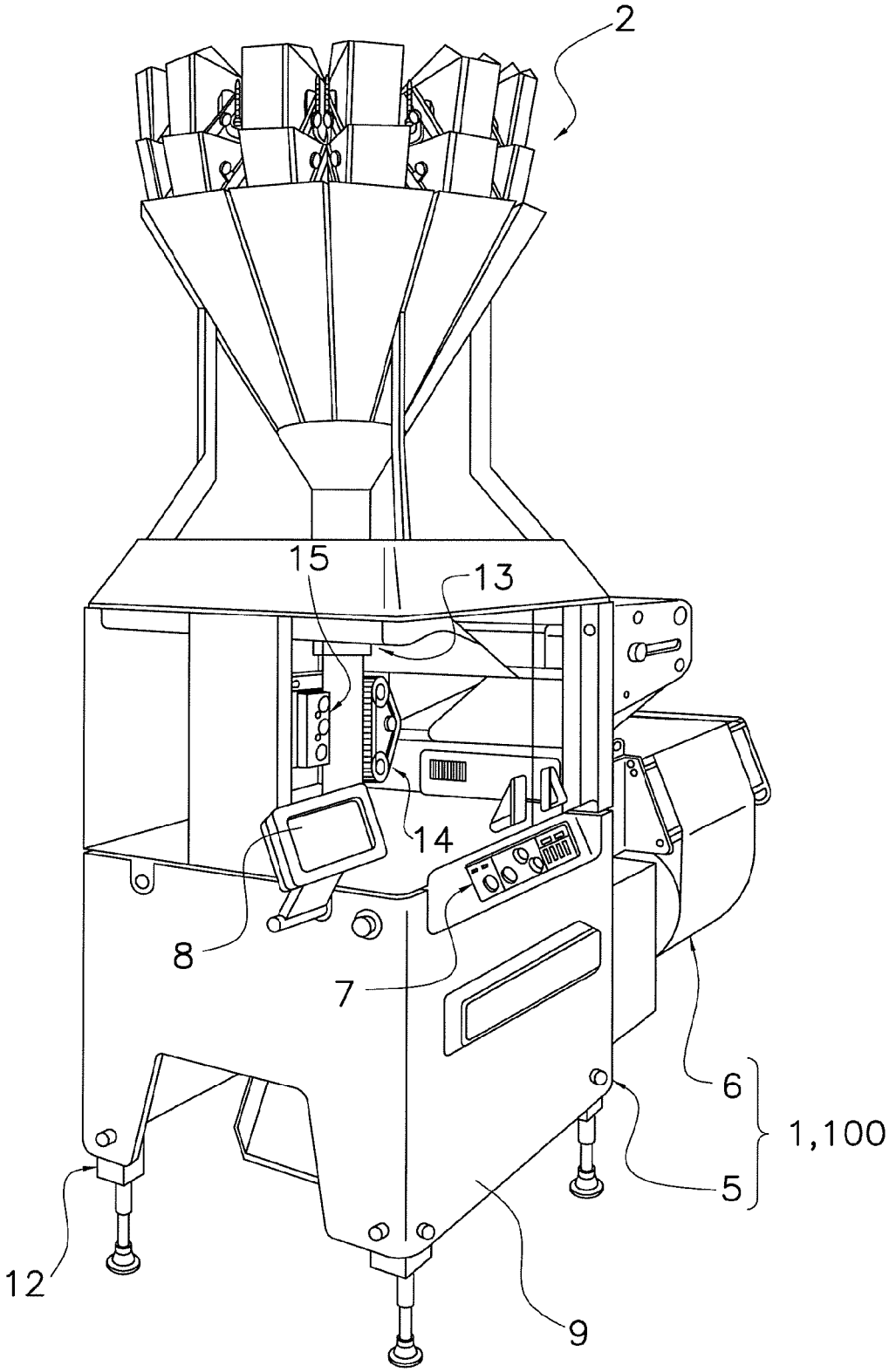
FIG. 1 is a perspective view of a bag manufacturing and packaging apparatus according to an embodiment of the present invention.
Figure 2:
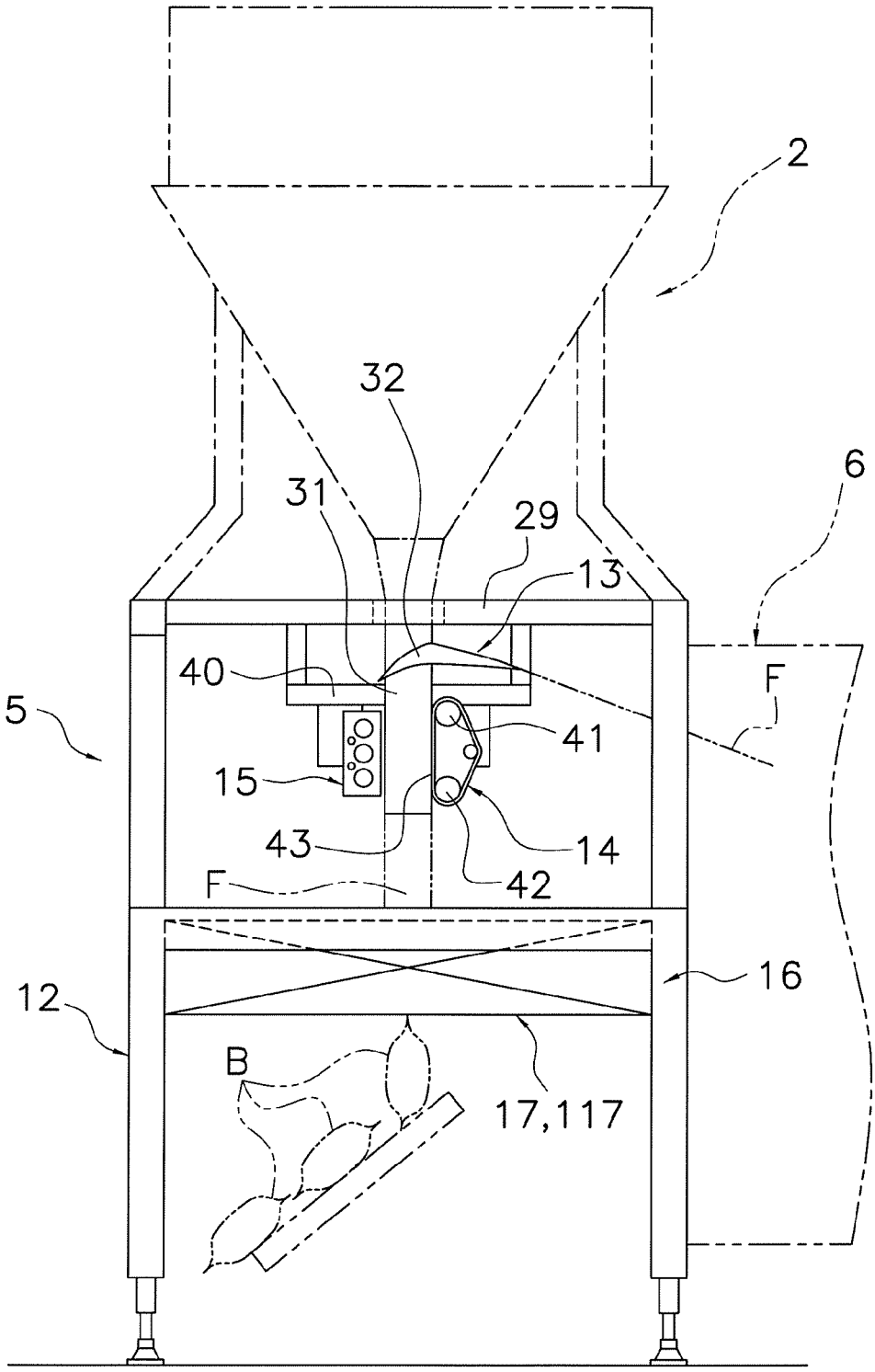
FIG. 2 is a lateral view of the bag manufacturing and packaging apparatus according to the embodiment of the present invention.

A bag manufacturing and packaging apparatus 1 according to an embodiment of the present invention is a machine that bags articles to be packaged C such as potato chips. As shown in FIGS. 1 and 2, the bag manufacturing and packaging apparatus 1 mainly includes a bag manufacturing and packaging unit 5 that is a main body that bags the articles to be packaged C, and a film supply unit 6 that supplies film that is formed into a bag to the bag manufacturing and packaging unit 5. In addition, operating switches 7 are arranged on the front side of the bag manufacturing and packaging unit 5. A liquid crystal display 8 that displays an operation state is arranged at a position where it is viewable by an operator who operates the operating switches 7.

The film supply unit 6 is a unit that supplies sheet-like film F to a forming mechanism 13 of the bag manufacturing and packaging unit 5 (described later). Here, the film supply unit 6 is provided adjacently to the bag manufacturing and packaging unit 5. A roll around which the film F is wound is set in the film supply unit 6, and the film F is paid out from the roll.

Figure 3:
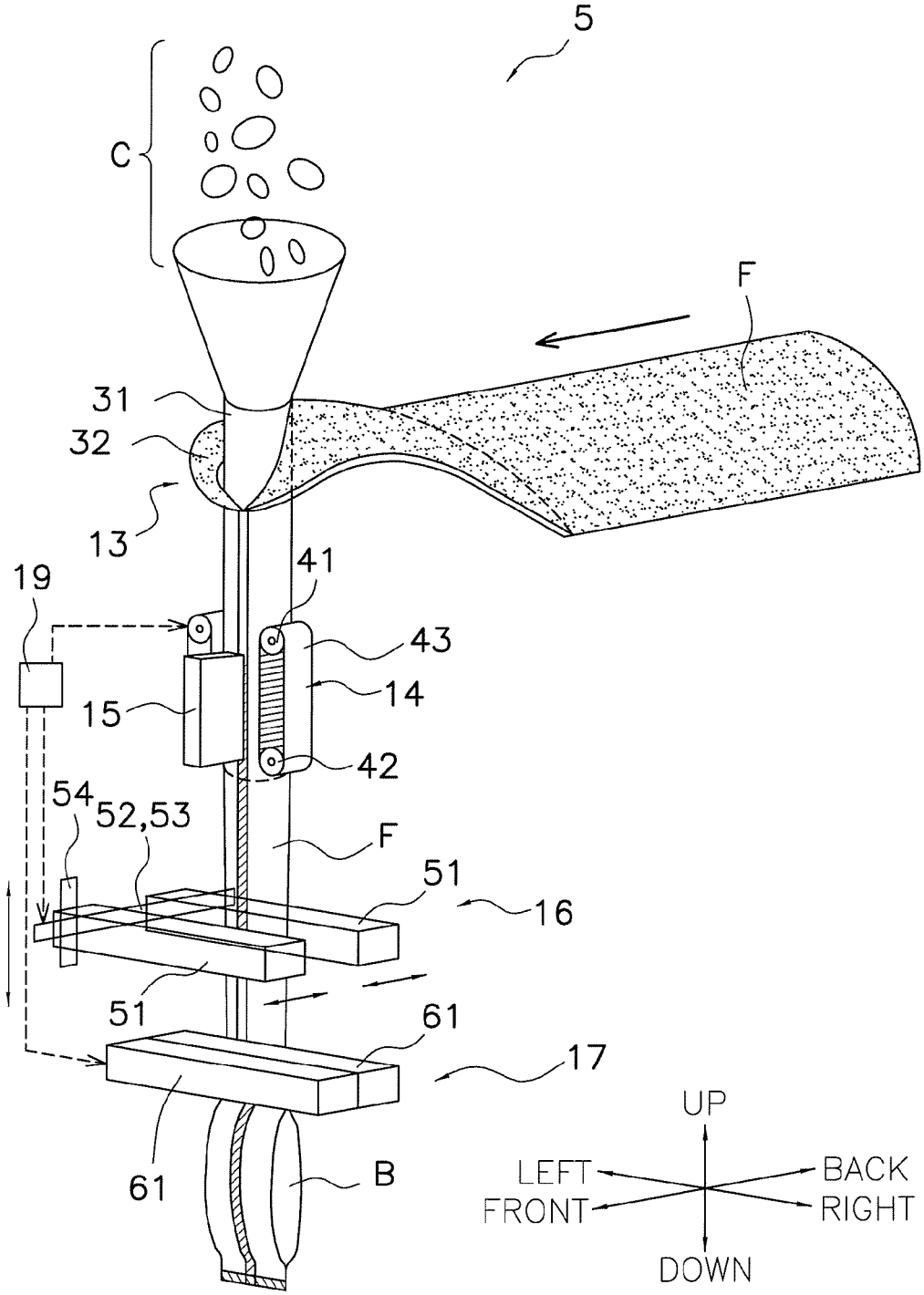
FIG. 3 is a schematic perspective view of a bag manufacturing and packaging unit of the bag manufacturing and packaging apparatus according to the embodiment of the present invention.

As shown in FIGS. 1 to 3, the bag manufacturing and packaging unit 5 includes the forming mechanism 13 that forms the film F, which is fed as a sheet, into a tubular shape; a pull-down belt mechanism (conveyance mechanism) 14 that conveys the tubularly shaped film F (hereinafter referred to as "tubular film F") in a downward direction; a longitudinal sealing mechanism 15 that longitudinally seals (thermal sealing) an overlapping portion of the tubular film F; a shaking mechanism 16 that clamps the tubular film F and imparts oscillation thereto; a transverse sealing mechanism (squeezing mechanism) 17 that closes upper and lower ends of the bag by transversely sealing the tubular film F; a support frame 12 that supports these mechanisms described above; and a control unit 19 that controls each mechanism of the bag manufacturing and packaging unit 5. In addition, a casing 9 is mounted around the support frame 12.

Detailed Structure of Bag Manufacturing and Packaging Unit 5

As shown in FIGS. 2 and 3, the forming mechanism 13 includes a tube 31 and a former 32.

The tube 31 is a cylindrical shaped member, and upper and lower ends thereof are opened. The tube 31 is disposed at an opening at the center of a top plate 29 in a plan view and integrated with the former 32 via a bracket (not shown). The weighed articles to be packaged C are fed to the opening at the upper end of the tube 31 from a computer scale 2.

The former 32 is disposed so as to surround the tube 31. The former 32 has a shape such that the sheet-like film F sent from the film supply unit 6 is shaped into a tubular shape while passing between the former 32 and the tube 31. The former 32 is also fixed on the support frame 12 via a support member (not shown).

The pull-down belt mechanism 14 and the longitudinal sealing mechanism 15 are supported by a rail 40 suspended from the top plate 29 and disposed so as to sandwich the tube 31 from both sides thereof. These mechanisms 14 and 15 are moved along the rail 40 so that their positions can be adjusted when the tube 31 is attached.

The pull-down belt mechanism 14 is a mechanism that suction-holds the tubular film F wound around the tube 31 and conveys the tubular film F downward. The pull-down belt mechanism 14 mainly includes a driving roller 41, a driven roller 42, and a belt 43 having a suction function. Note that, here, an illustration of a driving motor that rotates the driving roller 41 and the like are omitted.

The longitudinal sealing mechanism 15 is a mechanism that longitudinally seals an overlapping portion of the tubular film F wound around the tube 31 by applying heat to the overlapping portion while pressing the same against the tube 31 with a certain pressing force. The longitudinal sealing mechanism 15 includes a heater, a heater belt, which is heated by the heater and which comes into contact with the overlapping portion of the tubular film F, and the like. In addition, although not shown, the longitudinal sealing mechanism 15 is equipped with a driving device that moves the heater belt closer to and away from the tube 31.

The shaking mechanism 16 clamps the tubular film F being conveyed and imparts oscillation to the articles to be packaged C that were fed into the tubular film F in order to increase the density. Additionally, as shown in FIG. 3, the shaking mechanism 16 includes shutters (clamping mechanism) 51 and 51, a horizontally moving unit 52, an oscillating unit 53, and an up-down moving unit 54. Thus, in this embodiment, the shaking mechanism 16 preferably constitutes the conveyance adjusting unit.

The shutters 51 and 51 are configured such that they can move closer to and away from each other via the horizontally moving unit 52. Accordingly, when the shutters 51 and 51 are moved closer to each other, the tubular film F can be clamped therebetween. Further, the shutters 51 and 51 are configured to be movable in the vertical direction, i.e., the conveying direction of the tubular film F via the up-down moving unit 54. Accordingly, as the shutters 51 and 51 move in the vertically upward direction (direction opposite to the conveying direction) in a state of clamping the tubular film F therebetween, the tubular film F can be moved to the side opposite to the conveying direction. Note that, here, illustrations of a motor and the like that drive the horizontally moving unit 52, the up-down moving unit 54, and the like are omitted.

The oscillating unit 53 is configured so as to be capable of oscillating the shutters 51 and 51 in an up and down direction or horizontal direction. Additionally, the oscillating unit 53 oscillates the shutters 51 and 51 by, for example, converting a rotation motion of the motor and the like (not shown) to an up and down motion or horizontal motion. Accordingly, by oscillating the shutters 51 and 51 in a state of clamping the tubular film F, it is possible to impart oscillation to the tubular film F having the articles to be packaged C therein. As a result, it will increase the density of the articles to be packaged C that were subjected to oscillation.

As shown in FIG. 3, the transverse sealing mechanism 17 is configured so as to include a pair of sealing jaws (squeezing unit) 61 and 61 each having a built-in heater belt and the like, and a driving device (not shown) for moving the sealing jaws 61 and 61 closer to and away from the tubular film F.

As shown in FIG. 3, the sealing jaws 61 and 61 are members formed by extending in a left to right direction, and a sealing surface of each sealing jaw 61 is heated by the built-in heater belt and the like. The tubular film F is thermally sealed as the tubular film F is sandwiched between the sealing jaws 61 and 61 on left and right. In addition, the sealing jaws 61 and 61 can perform a so-called squeezing motion in which the articles to be packaged C remaining in the tubular film F are pushed out to the downstream side as the sealing jaws 61 and 61 move to the downstream side in the conveying direction in a state of sandwiching the tubular film F. In addition, the sealing jaws 61 and 61 can perform the squeezing motion even when the tubular film F is moved to the upstream side in the conveying direction in a state in which the sealing jaws 61 and 61 are sandwiching the tubular film F. Accordingly, it is possible to prevent sealing failure that occurs due to the articles to be packaged C remaining in the seal portion. Further, it is possible to shift the sealing position on the upper end side in the downward direction by pushing out the articles to be packaged C in the downward direction, i.e., to the seal portion on the lower end side. As a result, it is possible to reduce the size of a bag B that is completed when the upper and lower ends of the tubular film F are sealed.

The control unit 19 controls the movement of the shutters 51 and 51, which are included in the shaking mechanism 16, in the vertical direction (direction opposite to the conveying direction) and also controls each mechanism included in the bag manufacturing and packaging unit 5. Note that control of the shutters 51 and 51 by the control unit 19 is described in detail later.

Operation of Bag Manufacturing and Packaging Apparatus 1

Next, the operation of the bag manufacturing and packaging apparatus 1 is described with reference to FIGS. 3 to 7.

Basic Operation of Bag Manufacturing and Packaging Apparatus 1

As shown in FIG. 3, the sheet-like film F sent from the film supply unit 6 to the forming mechanism 13 is wound around the tube 31 from the former 32 to be formed into a tubular shape, and is conveyed downward as-is by the pull-down belt mechanism 14. Then, both end portions of the film F are brought to overlap each other on the peripheral surface in a state in which the film F is wound around the tube 31, and thereafter the overlapping portion is longitudinally sealed by the longitudinal sealing mechanism 15.

The tubular film F formed into a cylindrical shape by being longitudinally sealed moves through the tube 31 and downward to the transverse sealing mechanism 17. In addition, at this time, a batch of the articles to be packaged C drops from the computer scale 2 through the tube 31 simultaneously with the movement of the tubular film F. Then, in a state in which the articles to be packaged C are present in the tubular film F, the transverse sealing mechanism 17 transversely seals the upper end of the bag B and the lower end of another bag B above the aforementioned bag B in which the articles to be packaged C are present therein.

Shaking Motion, Squeezing Motion, and Transverse Sealing Motion in Bag Manufacturing and Packaging Apparatus 1

Here, the operation of the bag manufacturing and packaging apparatus 1 in which the tubular film F longitudinally sealed by the longitudinal sealing mechanism 15 is shaken by the shaking mechanism 16, squeezed by the transverse sealing mechanism 17, and transversely sealed is described.

Figure 4:
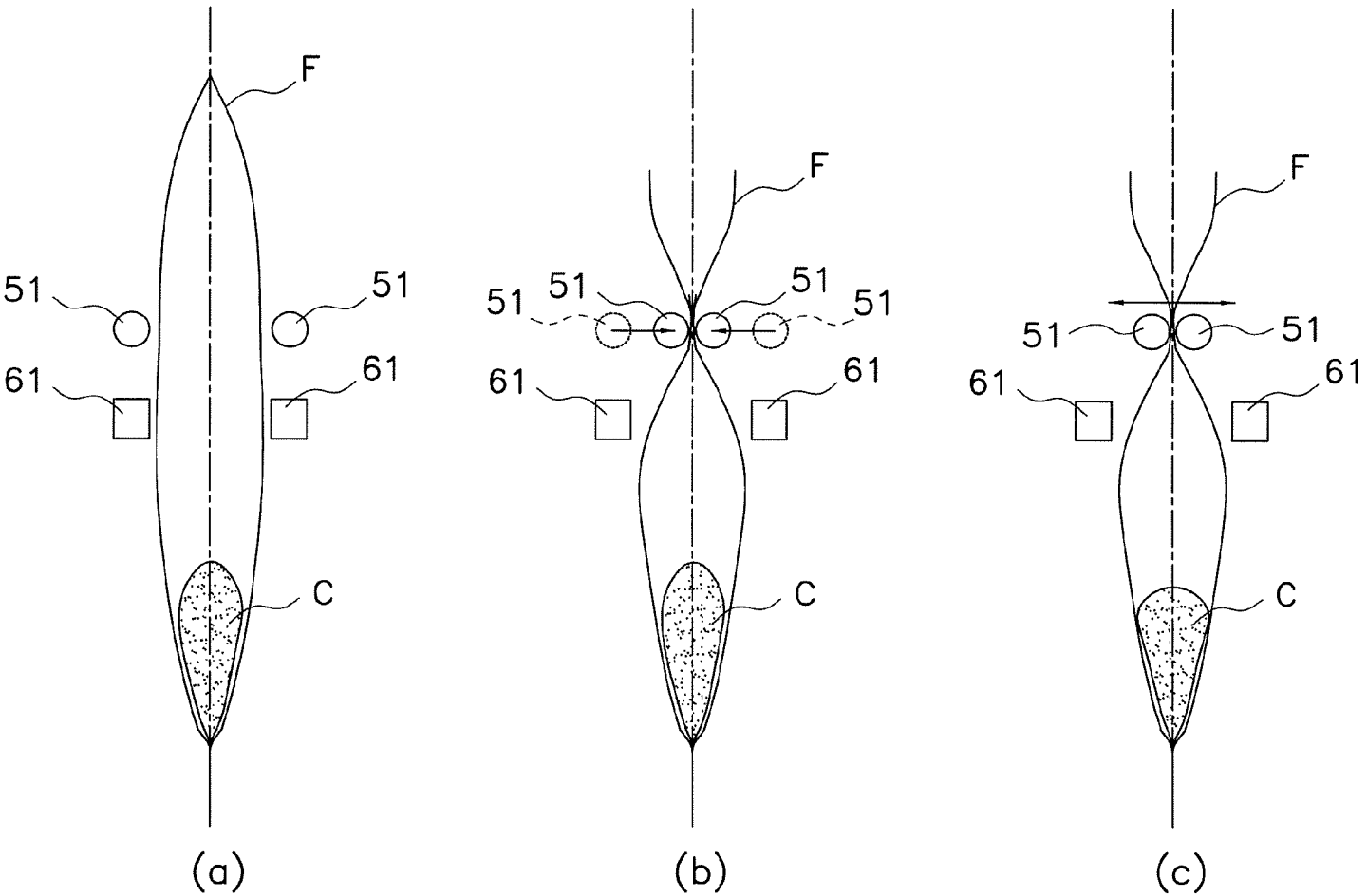
FIGS. 4(*a*) to (*c*) are schematic lateral views for describing the movements of shaking motion, squeezing motion, and transverse sealing motion according to the embodiment of the present invention.

As shown in FIG. 4(*a*), the pull-down belt mechanism 14 conveys the tubular film F that has been longitudinally sealed by the longitudinal sealing mechanism 15 with the articles to be packaged C included therein, and temporarily stops conveyance at a predetermined position (first step). Note that conveyance and the amount of conveyance of the tubular film F by the pull-down belt mechanism 14 are controlled by the control unit 19. At this time, the shutters 51 and 51 included in the shaking mechanism 16 and the sealing jaws 61 and 61 included in the transverse sealing mechanism 17 are disposed away from the conveying path of the tubular film F (open state).

When the conveyance of the tubular film F by the pull-down belt mechanism 14 is temporarily stopped at a predetermined position, as shown in FIG. 4(*b*), both of the shutters 51 and 51 move in the horizontal direction so as to approach the conveying path of the tubular film F (second step). Then, the shutters 51 and 51 will be in a state of sandwiching the tubular film F, and thereby the tubular film F can be firmly secured therebetween.

Next, the shutters 51 and 51 in a state of clamping the tubular film F are oscillated by the oscillating unit 53, thereby imparting oscillation (shake) to the tubular film F (fifth step). Note that the timing and amount of oscillation to shake the shutters 51 and 51 are controlled by the control unit 19. Accordingly, since oscillation can be imparted to the articles to be packaged C included inside the tubular film F, it is possible to increase the density of the articles to be packaged C. As a result, as shown in FIG. 4(*c*), the volume of the batch of the articles to be packaged C can be made smaller than the volume of the batch of the articles to be packaged C at the time of FIG. 4(*b*).

Figure 5:
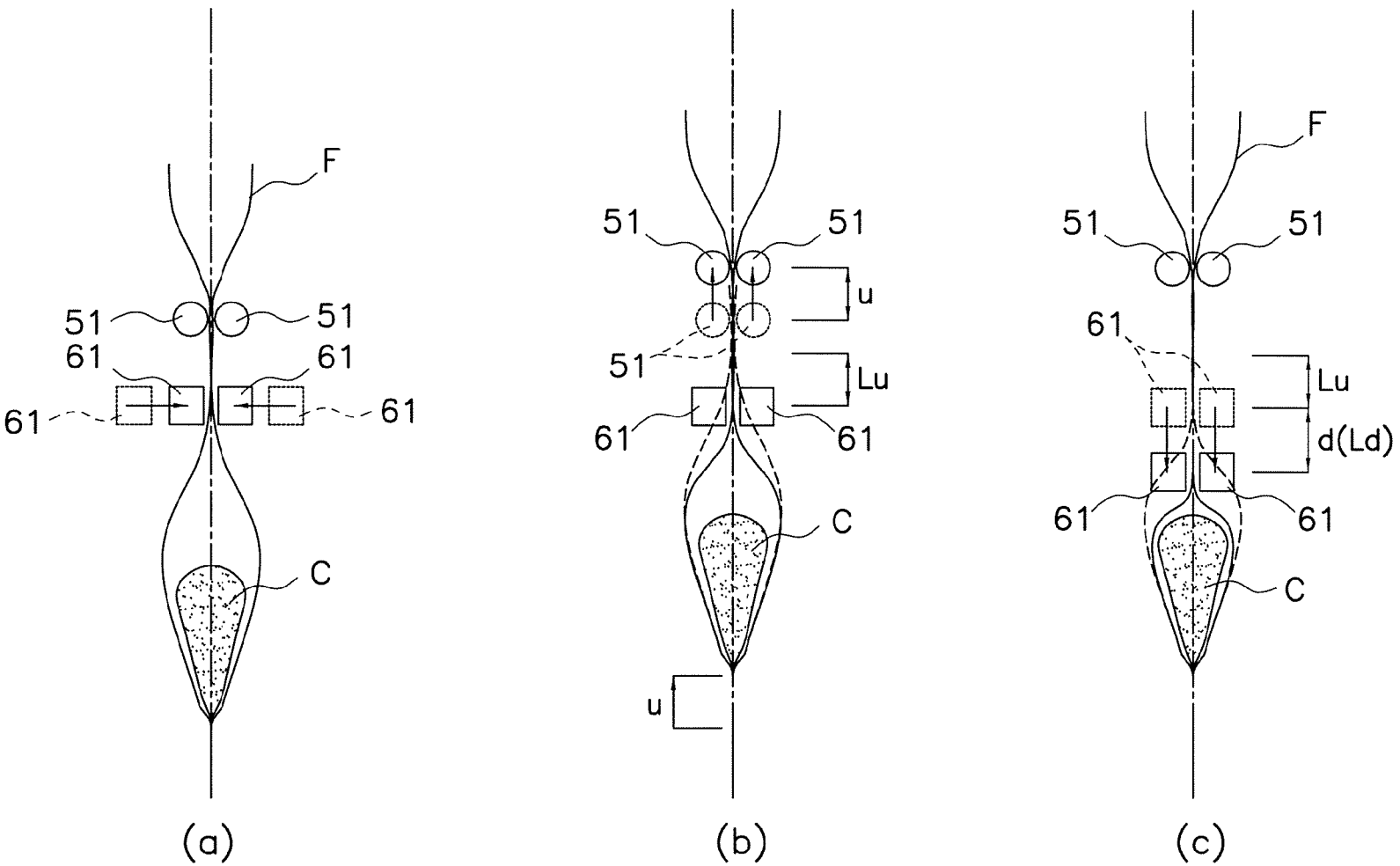
FIGS. 5(*a*) to (*c*) are schematic lateral views for describing the movements of shaking motion, squeezing motion, and transverse sealing motion according to the embodiment of the present invention.

Next, with respect to the tubular film F that is finished being shaken by the shaking mechanism 16, both of the sealing jaws 61 and 61 move in the horizontal direction so as to approach the conveying path of the tubular film F as shown in FIG. 5(*a*). Then, the sealing jaws 61 and 61 are arranged face-to-face at positions with a space therebetween in which the sealing jaws 61 and 61 can squeeze the tubular film F. In a state in which the sealing jaws 61 and 61 are arranged at such positions, for example, the sealing jaws 61 and 61 move to the downstream side in the conveying direction and the tubular film F moves to the upstream side in the conveying direction (side opposite to the conveying direction). Thereby, the sealing jaws 61 and 61 can perform the so-called squeezing motion (sliding motion) in which the articles to be packaged C in the tubular film F are pushed out to the downstream side in the conveying direction.

More specifically, as shown in FIG. 5(*b*), the shutters 51 and 51 in a state of clamping the tubular film F move by a distance u towards the upstream side in the conveying direction (fourth step). Note that the timing to move and amount of movement of the shutters 51 and 51 are controlled by the control unit 19. Here, the shutters 51 and 51 are controlled to move towards the upstream side in the conveying direction after the sealing jaws 61 and 61 are arranged at the positions capable of squeezing the tubular film F. As described above, the tubular film F is moved by the distance u to the side opposite to conveying direction by the shutters 51 and 51. At this time, since the sealing jaws 61 and 61 are arranged at the positions capable of squeezing the tubular film F as described above, the tubular film F is subjected to squeezing for a distance Lu, which is equal to the distance u of the movement of the tubular film F to the upstream side in the conveying direction caused by the shutters 51 and 51.

Note that the position where the shutters 51 and 51 clamp the tubular film F (see FIG. 5(*a*)) corresponds to the most downstream position within the movable range of the shutters 51 and 51 in the conveying direction, in other words, the lowest limit position within the movable range in the vertical direction.

Next, as shown in FIG. 5(*c*), the sealing jaws 61 and 61 move by a distance d to the downstream side in the conveying direction along the tubular film F (third step). Also at this time, as is the case in FIG. 5(*b*), since the sealing jaws 61 and 61 are arranged at the positions capable of squeezing the tubular film F, the tubular film F is subjected to squeezing for a distance Ld, which is equal to the distance d of the movement of the sealing jaws 61 and 61 to the downstream side in the conveying direction along the conveying direction.

Note that the position where the sealing jaws 61 and 61 start squeezing the tubular film F (FIG. 5(*b*)) corresponds to the most upstream position within the movable range of the sealing jaws 61 and 61 in the conveying direction, in other words, the uppermost limit position within the movable range in the vertical direction.

Figure 6:
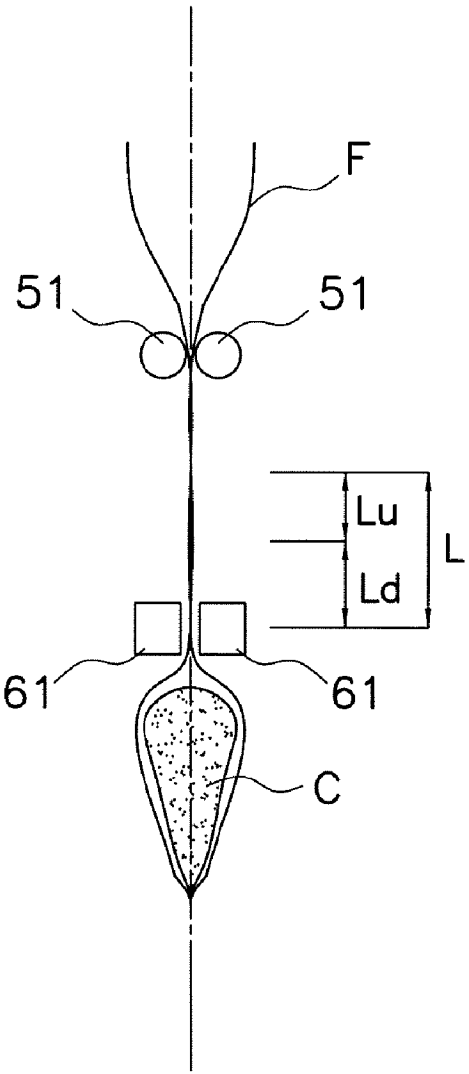
FIG. 6 is a schematic lateral view for describing the movements of shaking motion, squeezing motion, and transverse sealing motion according to the embodiment of the present invention.

Here, as shown in FIG. 6, a distance L in which the tubular film F was squeezed by the sealing jaws 61 and 61 is a sum of the distance Lu in which the tubular film F was squeezed as a result of the movement of the tubular film F by the distance u to the upstream side in the conveying direction caused by the shutters 51 and 51 and the distance Ld in which the tubular film F was squeezed as a result of the movement of the sealing jaws 61 and 61 by the distance d to the downstream side in the conveying direction along the conveying direction (L=Lu+Ld).

In this way, with the bag manufacturing and packaging apparatus 1 of the present invention, a distance obtained by adding the moving distance d of the sealing jaws 61 and 61 to the downstream side in the conveying direction and the moving distance u of the shutters 51 and 51 to the side opposite to the conveying direction can be the squeeze distance L(L=Lu+Ld). In other words, it is possible to extend the squeeze distance L with respect to the tubular film F without modifying the transverse sealing mechanism 17 to extend the moving distance Ld of the sealing jaws 61 and 61.

Figure 7:
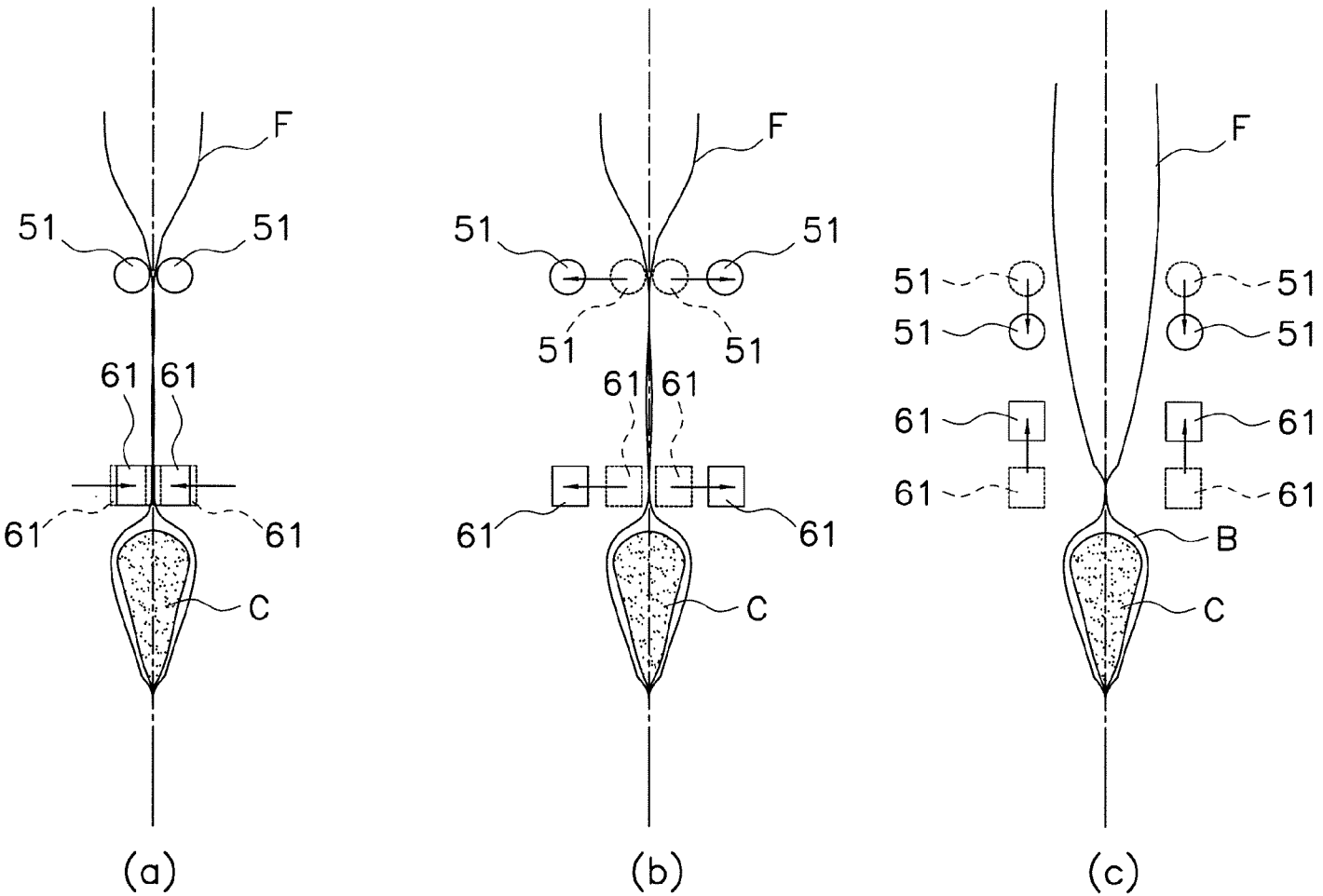
FIGS. 7(*a*) to (*c*) are schematic lateral views for describing the movements of shaking motion, squeezing motion, and transverse sealing motion according to the embodiment of the present invention.

Next, as shown in FIG. 7(*a*), the sealing jaws 61 and 61 completely sandwich the tubular film F therebetween and thermally seal the same by the sealing surface of each of the sealing jaws 61 and 61.

Next, as shown in FIG. 7(*b*), the sealing jaws 61 and 61 and the shutters 51 and 51 move in the horizontal direction to be in an open state shown in FIG. 5(*a*). At this time, the state in which the tubular film F is clamped by the shutters 51 and 51 is released. In addition, at the same time, the vicinity of the sealed portion of the tubular film F is cut by a cutter (not shown). Then, the tubular film F is separated off from the tubular film F on the upstream side and cut off as a bag B.

Next, the pull-down belt mechanism 14 releases the stopped state of the conveyance of the tubular film F at the time shown in FIG. 5(*a*), and again starts the conveyance of the tubular film F. At this time, as shown in FIG. 7(*c*), the shutters 51 and 51 move to the height position where the shutters 51 and 51 first clamped the tubular film F, i.e., the lowest limit position. In addition, as shown in FIG. 7(*c*), the sealing jaws 61 and 61 similarly move to the height position capable of starting squeezing the tubular film F at the beginning, i.e., the uppermost limit position.

Accordingly, the process is returned to the state shown in FIG. 5(*a*), and a series of the above described operation from shaking to sealing with respect to the tubular film F can be repeated.

Characteristics of Bag Manufacturing and Packaging Apparatus 1

(1) With the bag manufacturing and packaging apparatus 1 in this embodiment, the tubular film F is moved to the upstream side in the conveying direction during the squeezing motion of the sealing jaws 61 and 61.

Accordingly, it is possible to extend the squeeze distance Lu with respect to the tubular film F by the distance u of the movement of the shutters 51 and 51 to the upstream side in the conveying direction, i.e., by the distance u of the movement of the tubular film F to the upstream side in the conveying direction, even without extending the distance d of the movement of the sealing jaws 61 and 61 in the conveying direction. In other words, with the bag manufacturing and packaging apparatus 1 of the present invention, it is possible to relatively extend the squeeze distance L of the sealing jaws 61 and 61 with respect to the tubular film F by moving the tubular film F to the upstream side in the conveying direction, even without modifying the transverse sealing mechanism 17 to extend the distance Ld of the movement of the sealing jaws 61 and 61 in the conveying direction.

As a result, it is possible to extend the squeeze distance L with respect to the tubular film F without significantly modifying the transverse sealing mechanism 17, and the filling efficiency of the articles to be packaged into the product can be easily improved.

(2) With the bag manufacturing and packaging apparatus 1 in this embodiment, the shutters 51 and 51 that clamp the tubular film F are arranged so as to be movable in the conveying direction of the tubular film F, and the control unit 19 controls the shutters 51 and 51 so as to move to the upstream side in the conveying direction during the squeezing motion of the sealing jaws 61 and 61.

Accordingly, it is possible to extend the squeeze distance Lu with respect to the tubular film F by the distance u of the movement of the shutters 51 and 51 to the upstream side in the conveying direction, i.e., by the distance u of the movement of the tubular film F to the upstream side in the conveying direction caused by the shutters 51 and 51, even without extending the distance d of the movement of the sealing jaws 61 and 61 in the conveying direction. In other words, with the bag manufacturing and packaging apparatus 1 of the present invention, it is possible to relatively extend the squeeze distance L of the sealing jaws 61 and 61 with respect to the tubular film F by moving the shutters 51 and 51 that clamp the tubular film F to the upstream side in the conveying direction, even without modifying the transverse sealing mechanism 17 to extend the distance Ld of the movement of the sealing jaws 61 and 61 in the conveying direction.

As a result, it is possible to extend the squeeze distance L with respect to the tubular film F without significantly modifying the transverse sealing mechanism 17, and the filling efficiency of the articles to be packaged into the product can be easily improved.

(3) With the bag manufacturing and packaging apparatus 1 in this embodiment, the control unit 19 moves the shutters 51 arranged on the most downstream side to the most upstream position in the conveying direction during the squeezing motion of the sealing jaws 61 and 61.

Accordingly, the tubular film F that is clamped by the shutters 51 and 51 can be moved to the full extent toward the upstream side in conveying direction, so that it is possible to secure the maximum squeeze distance Lu which can be extended by moving the tubular film F by the shutters 51 and 51.

(4) With the bag manufacturing and packaging apparatus 1 in this embodiment, the control unit 19 oscillates the shutters 51 and 51 to impart oscillation to the tubular film F in order to gather the articles to be packaged C in the vertically downward direction before the sealing jaws 61 and 61 start the squeezing motion.

Accordingly, the bulkiness of the articles to be packaged C can be reduced by increasing the density thereof, so that the squeeze distance can be extended in the vertically downward direction by the corresponding amount. As a result, the transverse seal position can be shifted in the vertically downward direction and thereby the size of the product can be reduced. Thus, it is possible to further improve the filling efficiency of the articles to be packaged.

(5) With the bag manufacturing and packaging apparatus 1 in this embodiment, the so-called batch conveyance is performed in which the control unit 19 causes the pull-down belt mechanism 14 to stop conveying the tubular film F at least during the time when the sealing jaws 61 and 61 are performing the squeezing motion and the shutters 51 are clamping the tubular film F.

Accordingly, even when the shutters 51 and 51 are moved in a direction opposite to the conveying direction in a state of clamping the tubular film F, loosening of the tubular film F between the pull-down belt mechanism 14 and the shutters 51 and 51 can be minimized.

Alternative Embodiments

While only one embodiment of the present invention has been described, the scope of the invention is not limited to the above-described embodiment, and various changes and modifications can be made herein without departing from the scope of the invention.

(A) The bag manufacturing and packaging apparatus 1 in the above embodiment is described taking an example in which the sealing jaws 61 and 61 squeeze and transversely seal the tubular film F. However, the present invention is not limited thereto.

For example, it may be a type of bag manufacturing and packaging apparatus as shown below, in which the squeezing unit that squeezes the tubular film is a member separate from the transverse sealing unit that transversely seals the tubular film and these units are separately driven.

Figure 8:
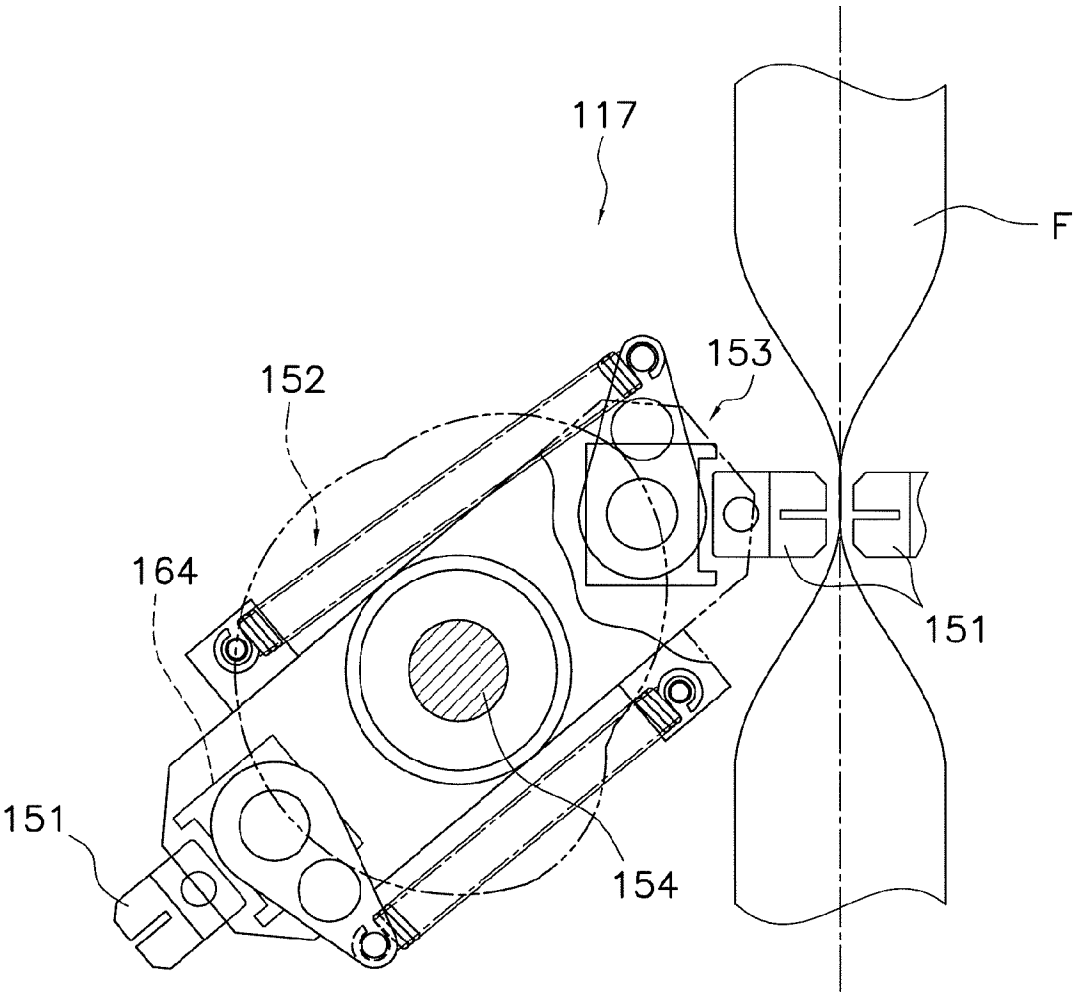
FIG. 8 is an enlarged view of a transverse sealing mechanism included in a bag manufacturing and packaging apparatus according to another embodiment of the present invention.

Here, a type of bag manufacturing and packaging apparatus 100 in which the squeezing unit that squeezes the tubular film F and the transverse sealing unit are separately driven is described with reference to FIGS. 8 and 9. Here, only a transverse sealing mechanism 117 is described, which is configured differently from the transverse sealing mechanism in the bag manufacturing and packaging apparatus 1 in the above embodiment. Descriptions of other components having the same configuration are omitted here.

The transverse sealing mechanism 117 is disposed below the forming mechanism 13, the pull-down belt mechanism 14, and the longitudinal sealing mechanism 15, and supported by the support frame 12. Note that squeezing mechanisms 150 for squeezing the articles to be packaged downward are disposed with the transverse sealing mechanism 117 in a manner associated with the transverse sealing mechanism 117.

The transverse sealing mechanism 117 includes the left and right symmetric pair of mechanisms 150. Although one of the pair of mechanisms 150 is described below, the other mechanism disposed on the other side has substantially the same configuration. Main differences between the two are that the only one of them has a cutter mechanism (not shown) and the shape of the cam is different.

This mechanism 150 causes two sealing jaws 151 and 151 to rotate in a D shape and causes the sealing jaws 151 to press against the facing sealing jaws 151 of the other mechanism 150 when the tubular film F is transversely sealed. This mechanism 150 mainly includes a cam 152, a support mechanism 153 that supports the sealing jaws 151, a rotation axis 154, and a transverse drive mechanism (not shown). Note that, as shown in FIGS. 8 and 9, the sealing jaws 151 and 151 are members formed by extending greater than the width of the tubular film in a direction perpendicular to the paper surface, and each sealing jaw 151 has a heater inside. The sealing surfaces of the sealing jaws 151 and 151 are heated by these heaters, and a portion of the tubular film F sandwiched by the left and right sealing jaws 151 and 151 is thermally sealed. In addition, the cam 152, the support mechanism 153, and the transverse drive mechanism are disposed on each of both ends of the sealing jaws 151 and 151 in the longitudinal direction. Here, a detailed description of each is omitted.

The squeezing mechanisms 150 are provided mainly so as to reduce occurrence of a situation where the articles to be packaged are caught in the sealed portion during the transverse sealing motion. By providing these mechanisms, it is possible to minimize occurrence of sealing failure even in a high-speed bag manufacturing and packaging process.

In addition, by utilizing the below described configuration and controlling the rotation speed of the rotation axis 154 so as to appropriately change the sealing jaws 151 and 151 of the transverse sealing mechanism 117 and stripper plates (squeezing units) 175 of the squeezing mechanisms 150, the sealing motion and the squeezing motion can be more preferably performed, reducing the rate of failure occurrence and enabling a further accelerated bag manufacturing and packaging process. Here, a detailed description of each is omitted.

Figure 9:
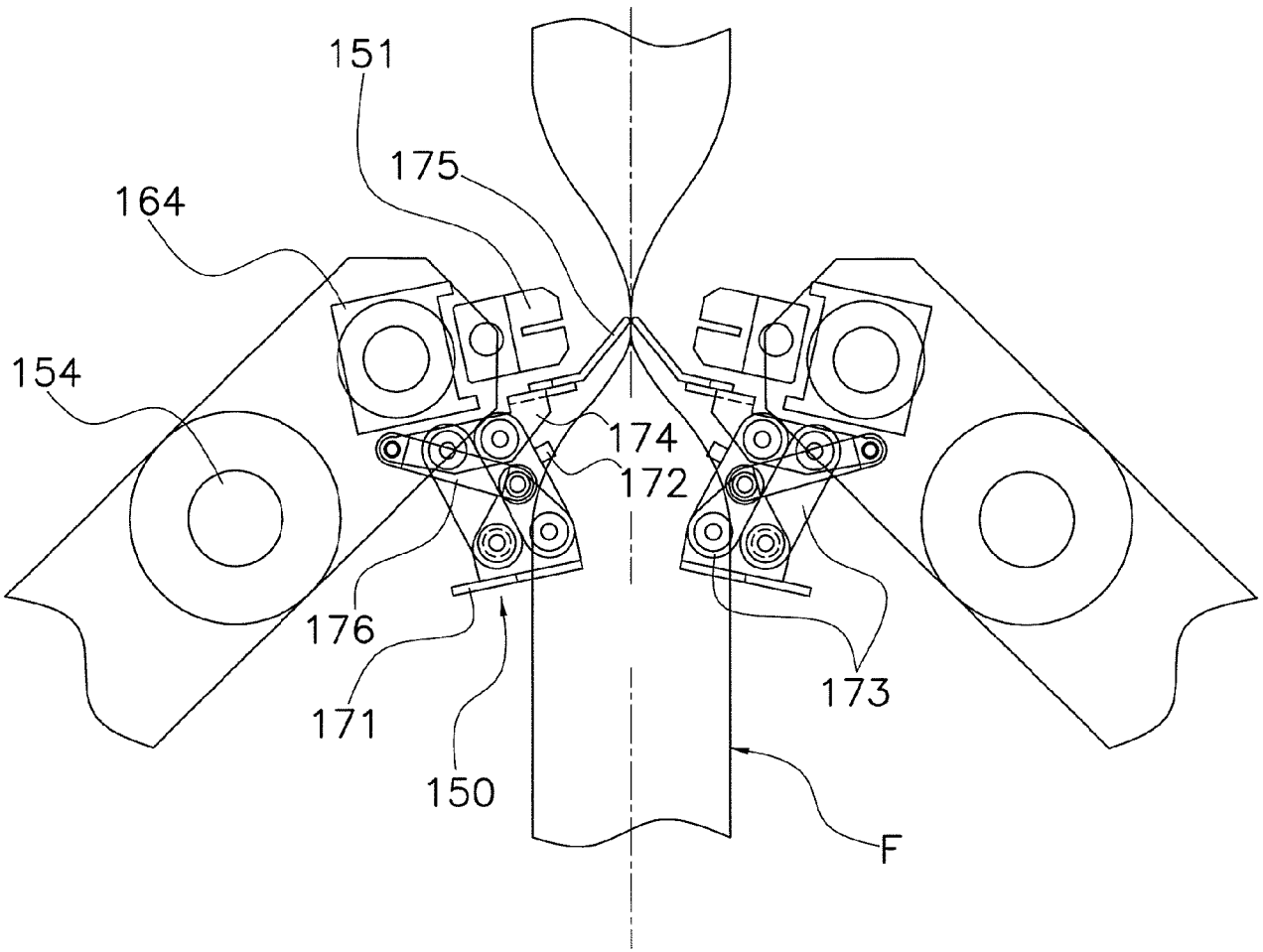
FIG. 9 is an enlarged view of a squeezing mechanism included in a bag manufacturing and packaging apparatus according to the embodiment illustrated in FIG. 8 according to another embodiment of the present invention.

As shown in FIG. 9, the squeezing mechanisms 150 comprise a left and right pair of mechanisms. The mechanisms are respectively supported by members 164 of the transverse sealing mechanism 117, which rotate oppositely with respect to each other. Each squeezing mechanism 150 includes a squeeze fixing member 171, a stripper 172, a parallel link member 173, a squeeze moving member 174, the stripper plate 175, and a spring member 176. Here, a detailed description of each member is omitted.

With such sealing mechanism 117, first, the stripper plates 175 sandwich the tubular film F therebetween. Then, in a state of sandwiching the tubular film F, the stripper plates 175 utilize the rotating motion to move the tubular film F to the downstream side in the conveying direction, and squeeze the articles to be packaged downward. The sealing jaws 151 and 151 move along a trajectory in a manner of following the trajectory of the stripper plates 175, and one sealing jaw 151 presses against the other facing sealing jaw 151 at a position where a predetermined squeeze distance is secured. At this time, a portion of the tubular film F sandwiched by the left and right sealing jaws 151 and 151 is thermally sealed.

When the above described bag manufacturing and packaging apparatus 100 is described through the operation of the bag manufacturing and packaging apparatus 1 in the above embodiment, the motion of the stripper plates 175 moving to the downstream side in the conveying direction in a state of sandwiching the tubular film F corresponds to the motion of the sealing jaws 61 and 61 moving to the downstream side in the conveying direction as shown in FIG. 5(*c*). Additionally, the motion of the sealing jaws 151 and 151 sandwiching and thermally sealing the tubular film F corresponds to the motion of the sealing jaws 61 and 61 thermally sealing the tubular film F as shown in FIG. 5(*a*).

In this way, even with the above described type of bag manufacturing and packaging apparatus 100 in which the stripper plates 175 that squeeze the tubular film F are the members separate from the sealing jaws 151 and 151 and are driven separately, the same effect as obtained by the bag manufacturing and packaging apparatus 1 according to the above described embodiment can be obtained.

(B) The bag manufacturing and packaging apparatus 1 in the above embodiment is described taking an example in which, as shown in FIG. 5(*b*) and (*c*), the sealing jaws 61 and 61 move to the downstream side in the conveying direction after the shutters 51 and 51 move to the side opposite to the conveying direction. However, the present invention is not limited thereto.

For example, the shutters may move to the side opposite to the conveying direction after the sealing jaws move to the downstream side in the conveying direction, or the shutters may move to the side opposite to the conveying direction at the same timing when the sealing jaws move. Here, as long as the control units controls the movement of the shutters during the time when the sealing jaws are arranged at positions capable of squeezing the tubular film, the same effect as obtained by the bag manufacturing and packaging apparatus 1 according to the above described embodiment can be obtained.

(C) The bag manufacturing and packaging apparatus 1 in the above embodiment is described taking an example in which the conveyance of the tubular film F by the pull-down belt mechanism 14 is stopped until the sealing jaws 61 and 61 transversely seal the tubular film F. However, the present invention is not limited thereto.

For example, the conveyance of the tubular film may be started by releasing the state in which the tubular film is clamped by the shutters after the tubular film is moved by the shutters. In this case, for example, as the transverse sealing mechanism squeezes and seals the tubular film while moving along with the conveyance of the tubular film, the same effect as obtained by the bag manufacturing and packaging apparatus 1 according to the above described embodiment can be obtained. In addition, in case of the transverse sealing mechanism 117 provided for the bag manufacturing and packaging apparatus 100 shown in the above described alternative embodiment (A), the same effect as obtained by the bag manufacturing and packaging apparatus 1 according to the above described embodiment can be obtained through the so-called D-motion.

(D) The bag manufacturing and packaging apparatus 1 in the above embodiment is described taking an example in which the shutters 51 and 51 that clamp the tubular film F are disposed so as to be movable in the conveying direction of the tubular film F and the control unit 19 controls the shutters 51 and 51 in a state of clamping the packaging material to move to the upstream side in the conveying direction during the squeezing motion of the sealing jaws 61 and 61. However, the present invention is not limited thereto.

Figure 10:
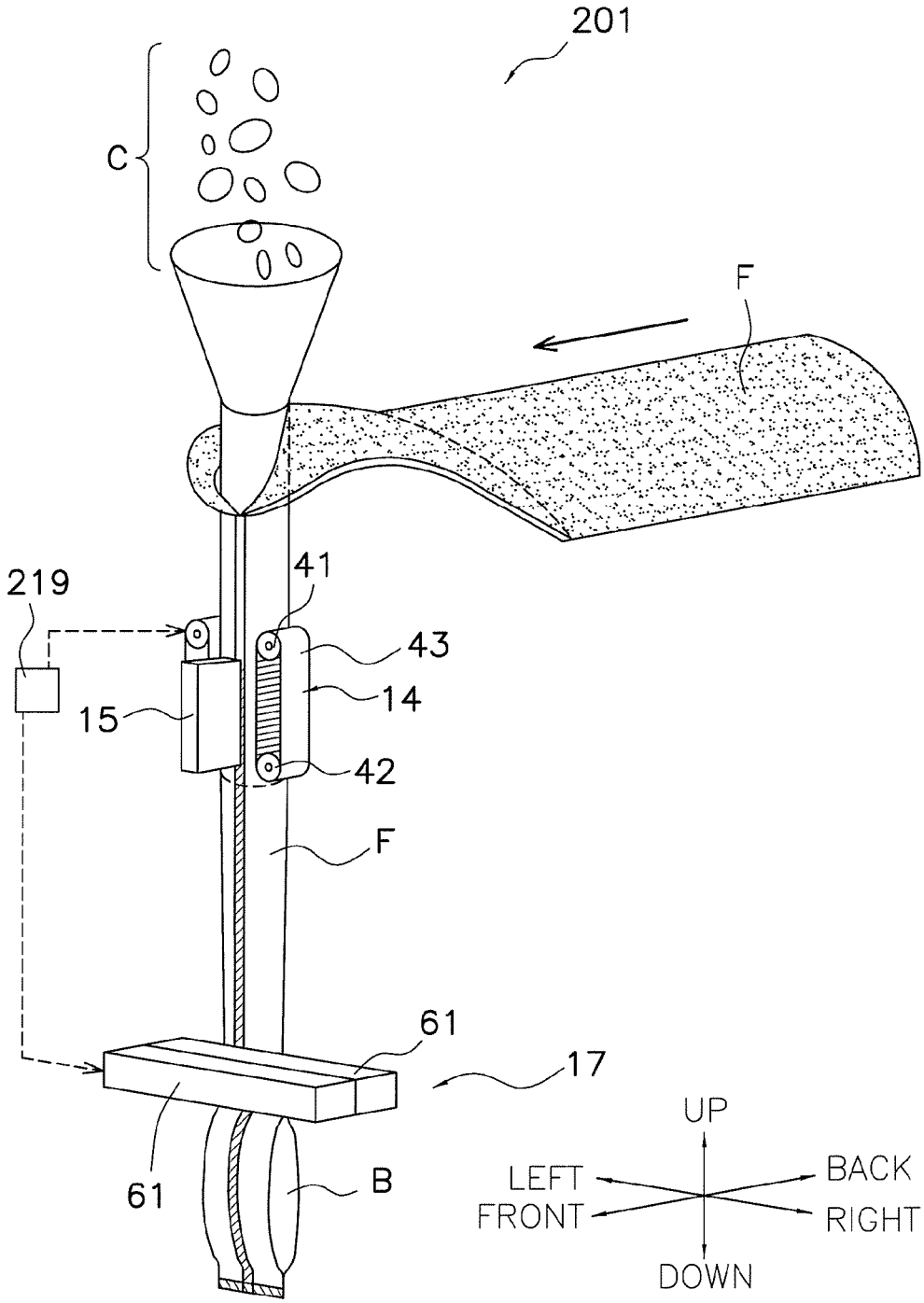
FIG. 10 is a perspective view of a bag manufacturing and packaging unit included in a bag manufacturing and packaging apparatus according to further another embodiment of the present invention.

For example, as shown in FIG. 10, even in case of a bag manufacturing and packaging apparatus 201 not provided with the shutters 51 and 51 (see FIG. 3) that would be included in the shaking mechanism 16 (see FIG. 3), a control unit (conveyance adjusting unit) 219 may control the pull-down belt mechanism (conveyance mechanism) 14 to convey the tubular film (packaging material) F in a direction opposite to the conveying direction (upstream side in the conveying direction, upward direction shown in FIG. 10) during the squeezing motion of the sealing jaws (squeezing units) 61 and 61.

In addition, for example, with the bag manufacturing and packaging apparatus shown in FIG. 3, the control unit may control both the conveyance mechanism and the shaking mechanism.

(E) The bag manufacturing and packaging apparatus 1 in the above embodiment is described taking an example in which the shaking mechanism 16 shakes the tubular film F. However, the present invention is not limited thereto.

The same effect as obtained by the bag manufacturing and packaging apparatus 1 according to the above described embodiment can be obtained even without the process in which the shaking mechanism shakes the tubular film. However, it is preferable that the tubular film is shaken in order to further increase the filling efficiency of the articles to be packaged which are included in the tubular film.

(F) The bag manufacturing and packaging apparatuses 1 and 100 in the above embodiments are described taking an example in which the control unit 19 controls each mechanism included in the bag manufacturing and packaging unit 5. However, the present invention is not limited thereto.

For example, the present invention can be implemented not only as the control unit to be mounted in the bag manufacturing and packaging apparatus but as a control program that causes the computer to perform the bag manufacturing and packaging method including shaking, squeezing, and transverse sealing with respect to the above described tubular film.

The invention claimed is:

1. A bag manufacturing and packaging apparatus that manufactures a bag by sealing a packaging material formed in a tubular shape and at the same time fills the bag with articles to be packaged, the bag manufacturing and packaging apparatus comprising:

a tube dimensioned to feed articles into the bag with the packaging material extending around an outer surface of the tube, the tube having an upper end and a lower end with a downstream direction of the flow of articles to be packaged corresponding to movement from the upper end in the direction of the lower end;

a conveyance mechanism configured and arranged to convey the packaging material in a conveying direction that parallels the downstream direction, the conveyance mechanism being operative to move the packaging material along the outer surface of the tube;

a squeezing mechanism including a squeezing unit configured and arranged to sandwich the packaging material at a first location below the lower end of the tube and to perform a squeezing motion so as to move the articles to be packaged in the downstream direction, the squeezing mechanism being configured and arranged to move in a direction perpendicular to the downstream direction for the squeezing motion and being separately configured and arranged to move in a direction parallel to the downstream direction along the packaging material; and a conveyance adjusting unit including a clamping mechanism configured and arranged to move in a direction perpendicular to the downstream direction to clamp the packaging material at a second location below the lower end of the tube and above the first location, the conveyance adjusting unit being configured and arranged to move the packaging material upward towards the lower end of the tube during the squeezing motion of the squeezing unit.

2. The bag manufacturing and packaging apparatus according to claim 1, wherein the conveyance adjusting unit includes a control unit configured to move the clamping mechanism while clamping the packaging material towards the lower end of the tube during the squeezing motion of the squeezing unit.

3. The bag manufacturing and packaging apparatus according to claim 2, wherein the control unit is configured to move the clamping mechanism from a most downstream position to a most upstream position relative to the downstream direction during the squeezing motion of the squeezing unit.

4. The bag manufacturing and packaging apparatus according to claim 2, wherein the control unit is configured to oscillate the clamping mechanism before the squeezing unit starts the squeezing motion.

5. The bag manufacturing and packaging apparatus according to claim 2, wherein the control unit is configured to control the conveyance mechanism to stop conveying the packaging material at least during the squeezing motion of the squeezing unit and during clamping of the clamping mechanism.

6. The bag manufacturing and packaging apparatus according to claim 1, wherein the conveyance adjusting unit is configured to control the conveyance mechanism to convey the packaging material in a direction opposite the downstream direction during the squeezing motion of the squeezing unit.

7. The bag manufacturing and packaging apparatus according to claim 1, wherein the squeezing mechanism is further configured to sandwich and seal the packaging material after finishing the squeezing motion.

8. A bag manufacturing and packaging method for filling a tubular packaging material being conveyed with articles to be packaged and sealing the packaging material, comprising:

at least partially forming a bag from the tubular packaging material about a tube, the tube having an upper end and a lower end, a downstream direction being defined in a direction extending from the upper end in the direction of the lower end;

feeding the articles to be packaged via the tube into the partially formed bag;

moving the partially formed bag and articles inside the partially formed bag downward below the lower end of the tube;

performing a squeezing motion in which the packaging material is sandwiched by a pair of jaws at a first location below the lower end of the tube as to move the articles to be packaged to the downstream side in the conveying direction of the packaging material; and clamping the packaging material at a second location above the first location and below the lower end of the tube with a pair of shutters and using the clamped pair of shutters to move the packaging material in an upstream direction opposite the downstream direction during the squeezing motion.

9. The bag manufacturing and packaging method according to claim 8, further comprising oscillating the packaging material before the performing of the squeezing motion.

10. The bag manufacturing and packaging method according to claim 8, further comprising sealing the packaging material to complete formation of the bag using the pair of jaws that performed the squeezing motion.

* * * * *